United States Patent [19]

Dodson

[11] 4,020,824

[45] May 3, 1977

[54] PORTABLE FIREPLACE GRATE HEATER

[75] Inventor: Stanton A. Dodson, South Lake Tahoe, Calif.

[73] Assignee: The Raymond Lee Organization, Inc., New York, N.Y. ; a part interest

[22] Filed: Apr. 21, 1975

[21] Appl. No.: 570,192

[52] U.S. Cl. ..... 126/164
[51] Int. Cl.[2] ..... F23H 13/00
[58] Field of Search ..... 126/121, 163, 164, 122, 126/129, 130, 131

[56] References Cited

UNITED STATES PATENTS

| | | | |
|---|---|---|---|
| 1,030,002 | 6/1912 | Livingston | 126/164 |
| 1,527,999 | 3/1925 | Thomas | 126/163 R |
| 1,640,771 | 8/1927 | Hannum | 126/121 |

FOREIGN PATENTS OR APPLICATIONS

| | | | |
|---|---|---|---|
| 74,394 | 12/1948 | Norway | 126/121 |

*Primary Examiner*—Ronald C. Capossela
*Attorney, Agent, or Firm*—Howard I. Podell

[57] ABSTRACT

A portable grate heater adaptable for use in a fireplace as a support for the material burned in the fireplace, as a means of supplying heat from the fire into the room adjoining the fireplace, and as a means of supplying fresh air to a fire on the grate. The grate is formed of a plurality of bent tubes of a shape to support logs mounted on a hollow chamber. Openings between the interior of the chamber and the tubes permits air in the chamber to circulate in the tubes, with the chamber fitted with an inlet and an outlet through which air from the room may be circulated. Valved openings are mounted on the forward end of the grate tubes for supplying air from the chamber to the fire.

2 Claims, 4 Drawing Figures

PORTABLE FIREPLACE GRATE HEATER

SUMMARY OF THE INVENTION

My invention is a portable grate heater adaptable for use in a fireplace as a support for the material burned in the fireplace, as a means of supplying heat from the fire into the room adjoining the fireplace, and as a means of supplying fresh air to a fire on the grate. The grate is formed of a plurality of bent tubes of a shape to support logs mounted on a hollow chamber. Openings between the interior of the chamber and the tubes permits air in the chamber to circulate in the tubes, with the chamber fitted with an inlet and an outlet through which air from the room may be circulated. Valved openings are mounted on the forward end of the grate tubes for supplying air from the chamber to the fire.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
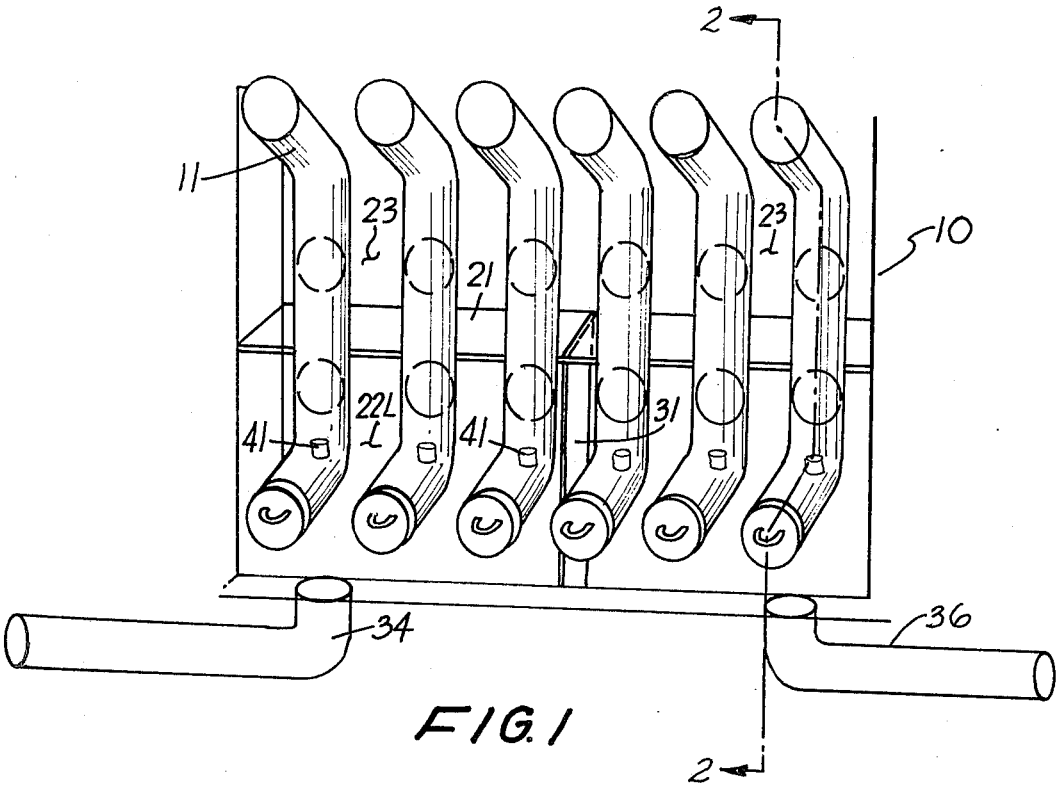
FIG. 1 is a plan perspective view of the invention.
Figure 2:
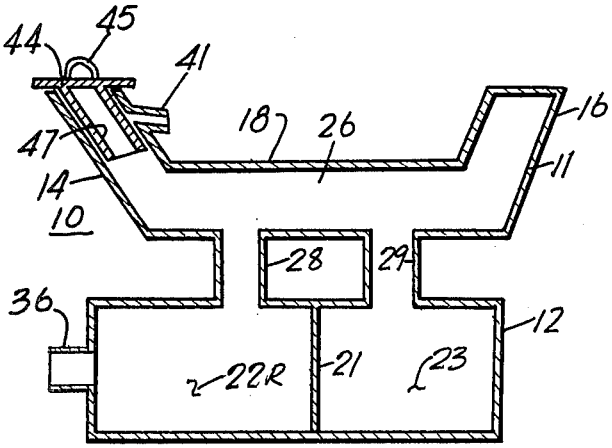
FIG. 2 is a side sectional view of the invention taken along the section line 2—2 of FIG. 1.
Figure 3:
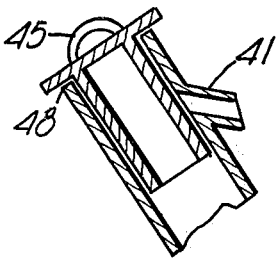
FIG. 3 is a fragmentary sectional view of a grate tube with the draft opening closed.
Figure 4:
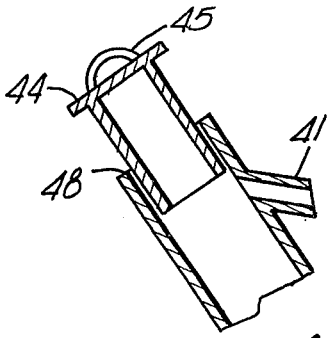
FIG. 4 is a fragmentary sectional view of a grate tube with the draft opening open.

Turning now descriptively to the drawings, in which similar reference characters denote similar elements throughout the several views, FIGS. 1–2 illustrate the grate heater 10 which is formed of a series of parallel hollow grate tubes 11 mounted above a hollow chamber base 12. Each tube 11 is bent with an upraised forward end 14 and an upraised rear end 16 joined to a horizontal central section 18. The interior of chamber base 12 is divided by perpendicular partitions 21 and 31 into a right and a left forward interior section 22R and 22L and rear interior section 23, with the interior 26 of each grate tube 11 joined by tubes 28 and 29 to a forward chamber section 22R or 22L and rear chamber section 23. An inlet tube 34, leading from a blower (not shown) is joined to forward chamber interior section 22L and an outlet tube 36 leads from the interior of forward chamber interior 22R, so that cold intake air blown through inlet tube 34 passes into forward chamber interior 22L then through a connecting grate support tube interior 28 into a grate interior 26. The flow of air forces heated air out of grate interior 26 through grate support tube 29 into rear chamber section 23 from which the heated air flows in similar fashion through another grate tube 11 mounted on the right side of the unit into front right chamber interior 22R and out of the chamber into the adjoining room through outlet tube 36.

Nozzle openings 41 may be mounted on the upper forward sections of grate tubes 11 to direct blown air from the grate tube interior 26 into the fire area to promote draft. A cap 44 fitted with an exterior handle 45 is formed with interior walls 47 to close nozzle opening 41 when cap 44 is seated fully in grate tube end 48, with partial removal of cap 44 serving to open adjacent nozzle opening 41.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A grate unit adaptable for support of burning material in a fireplace, which grate unit supplies heated air to an adjoining area, comprising a plurality of hollow grate tubes mounted on a hollow base, said hollow base enclosing a plurality of chambers separated by partition means with a first chamber serving as an inlet chamber and a second chamber serving as an outlet chamber, said base fitted with an inlet tube leading to the said inlet chamber and an outlet tube leading to the said outlet chamber, with the interior of each grate tube joined to two separate chambers of the base so that a set of the said grate tubes enclose a continuous passageway joining all the chambers of the base and extending from the said inlet chamber to the said outlet chamber.

2. The combination as recited in claim 1 in which a grate tube is fitted with an opening for directing air to the exterior of the grate for serving as a draft to burning materials on said grate tube.

* * * * *